US009089783B2

(12) United States Patent
Mkrtchyan

(10) Patent No.: US 9,089,783 B2
(45) Date of Patent: Jul. 28, 2015

(54) SYSTEM AND METHOD FOR A TOY TO INTERACT WITH A COMPUTING DEVICE THROUGH WIRELESS TRANSMISSIONS

(75) Inventor: Armen Mkrtchyan, Glendale, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 790 days.

(21) Appl. No.: 13/212,653

(22) Filed: Aug. 18, 2011

(65) Prior Publication Data

US 2013/0044570 A1 Feb. 21, 2013

(51) Int. Cl.
*G10K 11/00* (2006.01)
*A63H 3/28* (2006.01)

(52) U.S. Cl.
CPC ..... *A63H 3/28* (2013.01); *A63H 2200/00* (2013.01)

(58) Field of Classification Search
None
See application file for complete search history.

(56) References Cited

U.S. PATENT DOCUMENTS

| | | | | |
|---|---|---|---|---|
| 2003/0236872 | A1* | 12/2003 | Atkinson | 709/223 |
| 2008/0262928 | A1* | 10/2008 | Michaelis | 705/14 |
| 2009/0264205 | A1* | 10/2009 | Atsmon et al. | 463/42 |
| 2010/0127874 | A1* | 5/2010 | Curtis | 340/572.4 |
| 2011/0021109 | A1* | 1/2011 | Le et al. | 446/300 |
| 2011/0230116 | A1* | 9/2011 | Balik | 446/397 |
| 2013/0203345 | A1* | 8/2013 | Fisher | 455/41.1 |

* cited by examiner

*Primary Examiner* — Curtis King
(74) *Attorney, Agent, or Firm* — Patterson + Sheridan, LLP

(57) ABSTRACT

Techniques are disclosed that enable a toy device to interact with a computing device through wireless transmissions. The toy device is configured to communicate with the computing device by transmitting an audio signal at a nearly-inaudible frequency. The toy device may encode commands in the audio signal that cause the computing device to generate visual or auditory outputs. The toy device is also configured to receive and process interactions from human users and/or computing devices. The interactions may be in the form of speech or physical manipulations of the toy device. The toy device may respond to the interactions by generating visual or auditory outputs. The toy device may also process the interaction, and, in response, transmit an audio signal to the computing device.

20 Claims, 5 Drawing Sheets

SYSTEM AND METHOD FOR A TOY TO INTERACT WITH A COMPUTING DEVICE THROUGH WIRELESS TRANSMISSIONS

BACKGROUND

1. Field of the Invention

The present invention relates to toy devices and, in particular, to enabling a toy device to interact with a computing device through wireless transmissions.

2. Description of the Related Art

Conventional toy devices are configured to generate visual and auditory responses when physical interacted with by a human user. More recently toy devices have been developed that react to speech input from a human user or other source. Alternatively, the toy devices receive commands through a wired, infrared, or microwave radio connection or through a Bluetooth® connection. When physical interaction is not possible or a wired, infrared, microwave radio, or Bluetooth® connection is not available, interaction with the toy device may be limited or not possible.

As the foregoing illustrates, there is a need in the art for an improved technique for enabling interaction with a toy device.

SUMMARY

One embodiment of the invention provides a computer implemented method for enabling a toy device to interact with a computing device through wireless transmissions other than infrared, microwave radio, or Bluetooth® connections. The toy device is configured to communicate with the computing device by transmitting an audio signal at a nearly-inaudible frequency. The toy device may encode commands in the audio signal that cause the computing device to generate visual or auditory outputs. The toy device is also configured to receive and process interactions from human users and/or computing devices. The interactions may be in the form of speech, direct physical manipulations of the toy device, or interactions through input devices such as buttons, touch screens, and the like. The toy device may respond to the interactions by generating visual or auditory outputs. The toy device may also process the interaction, and, in response, transmit an audio signal to the computing device.

An embodiment of the invention includes a computer-implemented method for enabling interactions between a toy and a computing device. The method may generally include the toy device receiving an interaction, processing the interaction to generate an input, encoding the input into an audio signal; and wirelessly transmitting, at a nearly-inaudible frequency, the audio signal to the computing device.

Other embodiments include, without limitation, a computer-readable medium that includes instructions that enable a processing unit to implement one or more aspects of the disclosed methods as well as a system configured to implement one or more aspects of the disclosed methods.

One advantage of the techniques described herein is that a toy device is enabled to interact with computing devices wirelessly, through audio signals. Not only can the toy device receive and respond to transmissions from a computing device at audible frequencies, but the toy device can also receive and respond to transmissions from a computing device nearly inaudible frequencies. Additionally, the toy device is configured to transmit inputs, such as commands, to the computing device using audio signals at nearly inaudible frequencies. The toy device may receive interactions from a human user, process those interactions and generate inputs that are transmitted to the computing device. The ability to receive and transmit interactions and inputs wirelessly between the toy and computing devices allows for more and varied interactions between the toy device, computing devices, broadcast television, video playback, and human users.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF EXEMPLARY EMBODIMENTS

Figure 1A:
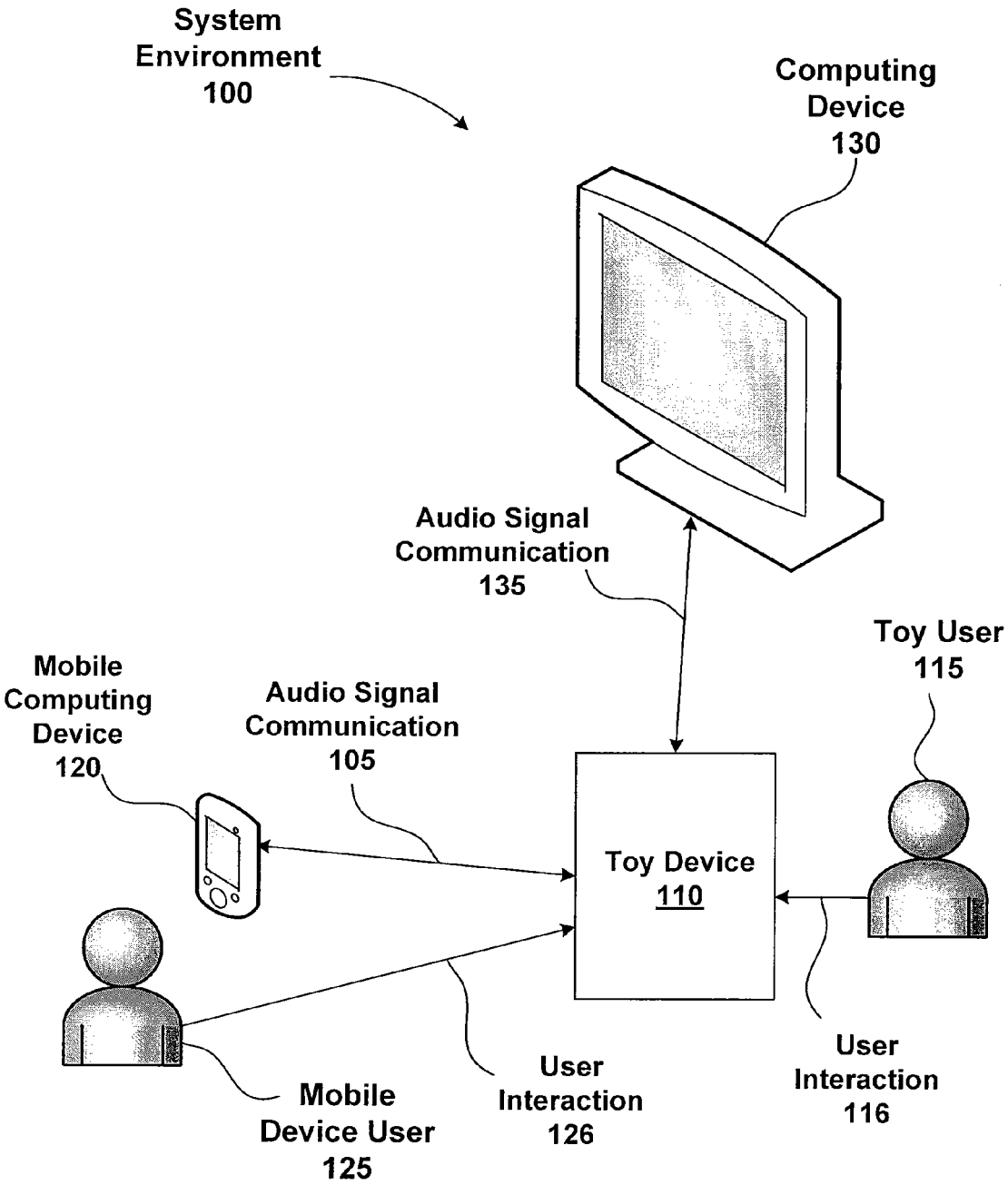
FIG. 1A shows a diagram of a system environment, according to one embodiment of the invention.

Embodiments of the invention include a system that enables a toy device to interact with a computing device through wireless transmissions. The toy device is configured to communicate with the computing device by transmitting an audio signal at a nearly-inaudible frequency. The toy device may encode commands in the audio signal that cause the computing device to generate visual or auditory outputs. The toy device is also configured to receive and process interactions from human users and/or computing devices. The interactions may be in the form of speech or physical manipulations of the toy device. The toy device may respond to the interactions by generating visual or auditory outputs. The toy device may also process the interaction, and, in response, transmit an audio signal to the computing device.

One embodiment of the invention provides a computer-implemented method for enabling interactions between a toy and a computing device. The method may generally include the toy device receiving an interaction, processing the interaction to generate an input, encoding the input into an audio signal; and wirelessly transmitting, at a nearly-inaudible frequency, the audio signal to the computing device.

In the following, reference is made to embodiments of the invention. However, it should be understood that the invention is not limited to specific described embodiments. Instead, any combination of the following features and elements, whether related to different embodiments or not, is contemplated to implement and practice the invention. Furthermore, although embodiments of the invention may achieve advantages over other possible solutions and/or over the prior art, whether or not a particular advantage is achieved by a given embodiment is not limiting of the invention. Thus, the following aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

As one skilled in the art will appreciate, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be used. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, radio frequency, etc., or any suitable combination of the foregoing.

Computer program code for carrying out operations for aspects of the present invention may be written in any combination of one or more programming languages, including an object oriented programming language such as Java, Smalltalk, Objective C, C++ or the like and conventional procedural programming languages, such as the "C" programming language or similar programming languages. The program code may execute entirely on the user's computing device, partly on the user's computing device, as a stand-alone software package, partly on the user's computer and partly on a remote computing device or entirely on the remote computer or server. In the latter scenario, the remote computing device may be connected to the user's computing device through any type of network, including a local area network (LAN) or a wide area network (WAN), or the connection may be made to an external computing device (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

FIG. 1A shows a diagram of a system environment 100, according to one embodiment of the invention. A toy device 110 is configured to communicate with a computing device 130 through audio signal communication 135 and a mobile computing device 120 through audio signal communication 105. Importantly, the communication with the toy device 110 is bi-directional. The audio signal communications 135 and 105 represent wireless transmissions of audio signals using various frequencies. In particular, some communications through the audio signal communication 105 and/or 135 may occur using nearly inaudible high frequencies of 16-20 kHz. Other communications through the audio signal communication 105 and/or 135 may occur using frequencies in a range that is audible to most humans.

The toy device 110 may be a push toy, doll, action figure, vehicle, play set, or the like. The toy device 110 is configured with a voice recognition capability that recognizes spoken phrases as well as the nearly inaudible audio transmissions. A toy user 115 may interact with the toy device 110 directly through user interaction 116, e.g., physical manipulation of the toy device 110 by the toy user 115 or audible speech. Similarly, a mobile device user 125 may interact with the toy device directly through user interaction 126. The mobile device user 125 may also interact with the toy device 110 through the mobile computing device 120; again using speech or physical manipulation of the mobile computing device 120.

An example use of the system environment 100 is to execute an application program on the mobile computing device 120 that produces audible sound output as an audio signal. When the audio signal is received by the toy device 110 through the audio signal communication 105, the toy device 110 may respond to the audio sound by performing a physical movement, generating audible audio output, and/or operating lights. The toy device 110 may also respond by transmitting a nearly inaudible signal to the computing device 130 through the audio signal communication 135. The nearly inaudible signal may encode a command for execution by the computing device 130 that causes the computing device 130 to display an image and/or generate an audible sound. For example, the toy device 110 may transmit a command that causes an avatar displayed by the computing device 130 that represents the toy device 110 perform physical movements. In another example, the toy user 115 may interact with the toy device 110 to cause the avatar to mimic physical movements of the toy device 110, perform other movements, and/or produce audible sounds.

Figure 1B:
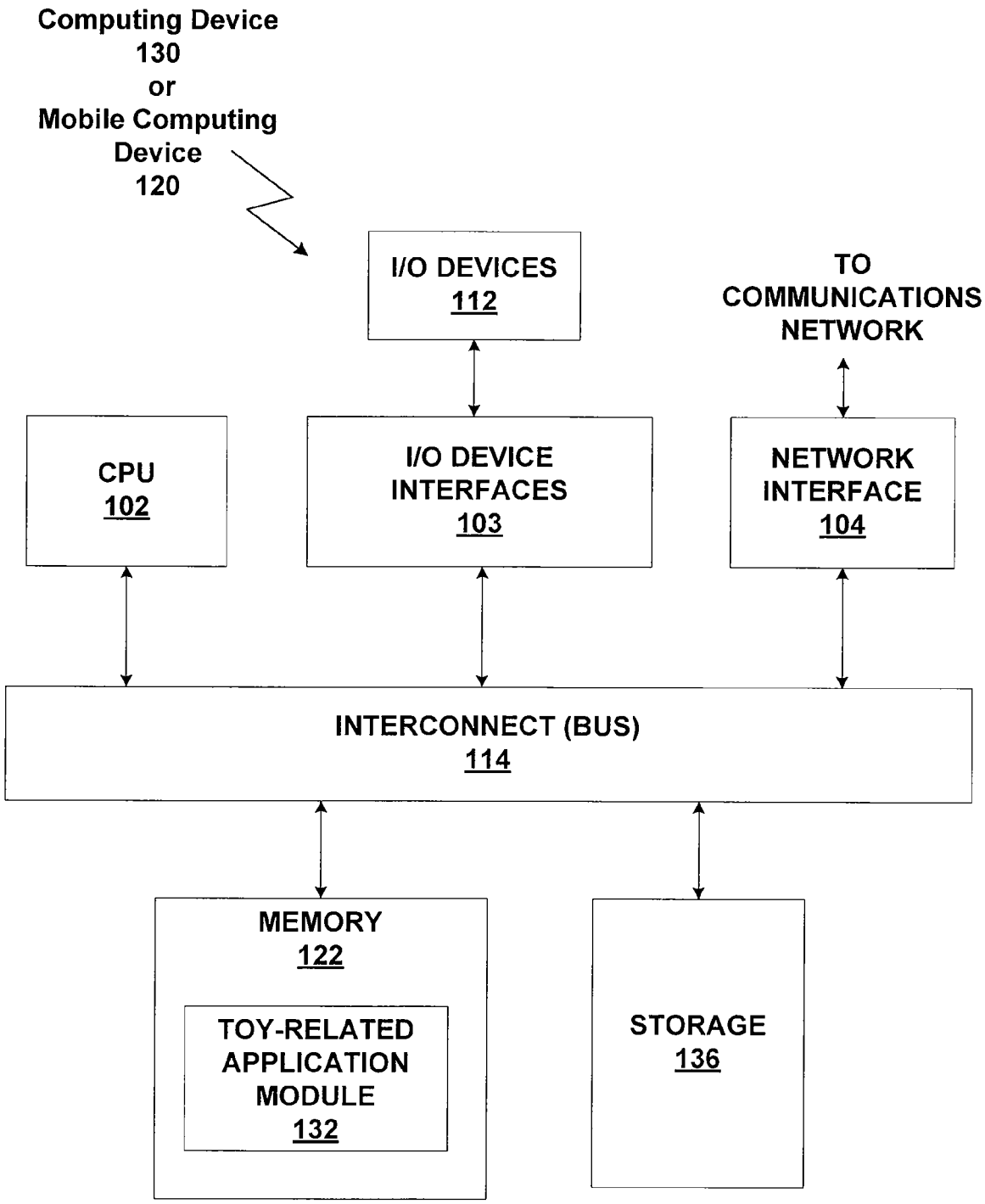
FIG. 1B illustrates the computing device or the mobile computing device of FIG. 1A, according to one embodiment of the invention.

FIG. 1B shows a high-level block diagram of the computing device 130 or the mobile computing device 120 in the context of the system environment 100, according to one embodiment of the invention. As shown, the computing device 130 or the mobile computing device 120 includes, without limitation, a central processing unit (CPU) 102, a network interface 104, an interconnect 114, a memory 122, input/output (I/O) devices 112, I/O device interfaces 103, and storage 136. The CPU 102 retrieves and executes programming instructions stored in the memory 122, e.g., the toy-related application module 132. The interconnect 114 is used to transmit programming instructions and application data between the CPU 102, I/O devices interfaces 103, storage 136, network interface 104, and memory 122. CPU 102 is included to be representative of a single CPU, multiple CPUs, a single CPU having multiple processing cores, and the like. And the memory 122 is generally included to be representative of a random access memory. Storage 136, such as a hard disk drive or flash memory storage drive (e.g., a solid state device (SSD)), may store non-volatile data. The network interface 104 may allow the computing device 130 and the mobile computing device 120 to share resources or information over a wired or wireless communications network.

The computing device 130 and the mobile computing device 120 may also include an I/O devices interface 110 connecting I/O devices 112 (e.g., speakers, a microphone, keyboard, display, mouse devices, and the like). Audio signals output by the toy device 110 may be received by the I/O devices 112, e.g., microphone. Audio signals may be output by the computing device 130 and the mobile computing device 120 through the I/O devices 112, e.g., speakers. A toy-related application module 132 that is stored in the memory 122 and executed by the CPU 102 is configured to process audio signals received from the toy device 110 and from the mobile device user 125 to generate an input. The toy-related application module 132 is configured to determine a response to the input. Example responses include outputting a sound and/or and displaying an image by the computing device 130 and the mobile computing device 120.

In one embodiment, the computing device 130 may include existing computer systems, e.g., desktop computers, server computers, laptop computers, tablet computers, televisions, and the like. The mobile computing device 120 may also comprise a general computing device, such as a laptop, handheld device, cell phone, tablet computer, smartphone, and the like. For example, the computing device 130 and the mobile computing device 120 may comprise a console designed for execution of games, such as an arcade machine, a SONY PLAYSTATION 3, NINTENDO Wii, or a MICROSOFT XBOX 360. The computing device 130 and the mobile computing device 120 may also comprise a general computing device configured for execution of games, such as a laptop, desktop, tablet, or personal computer. The toy-related application module 132 may be a game-type of program and the toy device 110 may be represented as an avatar, e.g. entity or character in a virtual world.

The computing device 130 and the mobile computing device 120 may be configured for the playback of digital media to generate audio and visual outputs. The toy device 110 may respond to the audio output transmitted by the computing device 130 and the mobile computing device 120. As previously explained, the computing device 130 and the mobile computing device 120 may encode commands intended for the toy device 110 in nearly inaudible audio transmissions. The toy device 110 may also respond to audible audio signals generated and transmitted by the computing device 130 and the mobile computing device 120.

Figure 1C:
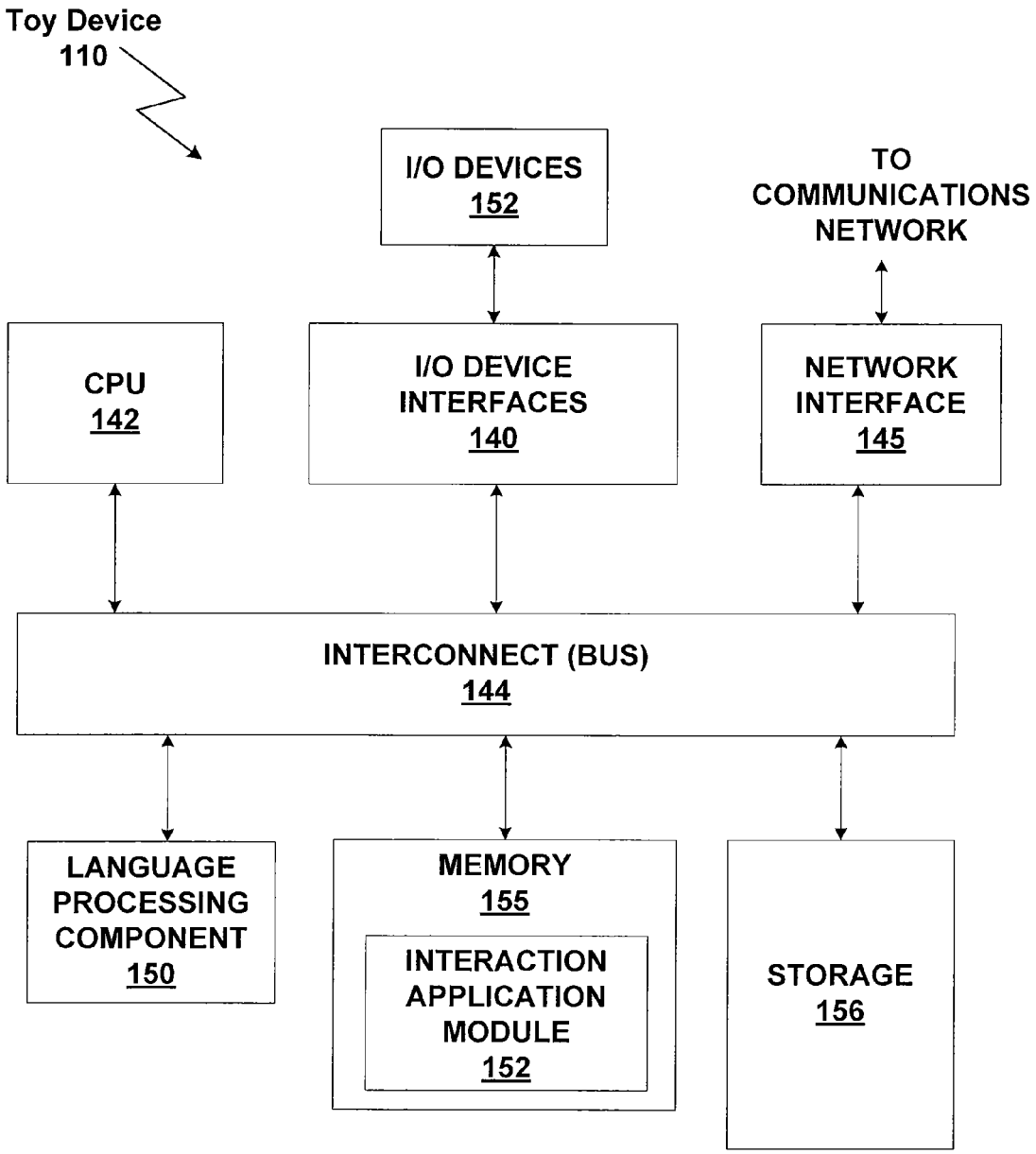
FIG. 1C illustrates the toy device of FIG. 1A, according to one embodiment of the invention.

FIG. 1C illustrates the toy device 110 of FIG. 1A configured according to one embodiment of the invention. As shown, the toy device 110 includes, without limitation, a central processing unit (CPU) 142, a network interface 145, an interconnect 144, a memory 155, input/output (I/O) devices 152, I/O device interfaces 140, a language processing component 150, and storage 156. The CPU 142 retrieves and executes programming instructions stored in the memory 152, e.g., the interaction application module 152. The interconnect 144 is used to transmit programming instructions and application data between the CPU 142, I/O devices interfaces 140, storage 156, language processing component 150, network interface 145, and memory 155. CPU 142 is included to be representative of a single CPU, multiple CPUs, a single CPU having multiple processing cores, and the like. And the memory 155 is generally included to be representative of a random access memory. Storage 156, such as a hard disk drive or flash memory storage drive (e.g., a solid state device (SSD)), may store non-volatile data. The network interface 145 may allow the toy device 110 to share resources or information over a wired or wireless communications network.

The toy device 110 may also include an I/O devices interface 140 connecting I/O devices 152 (e.g., speakers, a microphone, keyboard, display, mouse devices, and the like). The I/O devices 152 may also include one of more of buttons, gravity switches, joint switches, touch areas, accelerometer, gyroscope, magnetic switch, and the like, that are included within or on the surface of an enclosure of the toy device 110. Audio signals output by the toy user 115, the computing device 130, and the mobile computing device 120 may be received by the I/O devices 152, e.g., microphone. Audio signals may be output by the toy device 110 through the I/O devices 152, e.g., speakers. An interaction application module 152 that is stored in the memory 155 and executed by the CPU 142 is configured to process audio signals received from the toy device 110 using the language processing component 150, as needed, to generate an input. The language processing component 150 may include circuitry dedicated for voice recognition and/or speech or natural language processing. The interaction application module 152 is configured to determine a response to the input. Example responses include outputting an audio signal, physically moving portions of the toy device 110, and/or and activating lights on or within the toy device 110.

The toy device 110 may be configured for the playback of digital media to generate audio and visual outputs. The toy device 110 may respond to the audio output transmitted by the computing device 130 and the mobile computing device 120. As previously explained, the computing device 130 and the mobile computing device 120 may encode commands intended for the toy device 110 in nearly inaudible audio transmissions. The toy device 110 may also respond to interactions received from the toy user 115 and to audible audio signals generated and transmitted by the computing device 130 and the mobile computing device 120. Example interactions performed by the toy user 115 may include physically manipulating the position of the toy device 110 causing a gravity switch to detect a rotation of the toy device 110. The toy device 110 may respond by snoring when laid on its side or yawn when rotated upright.

Figure 2A:
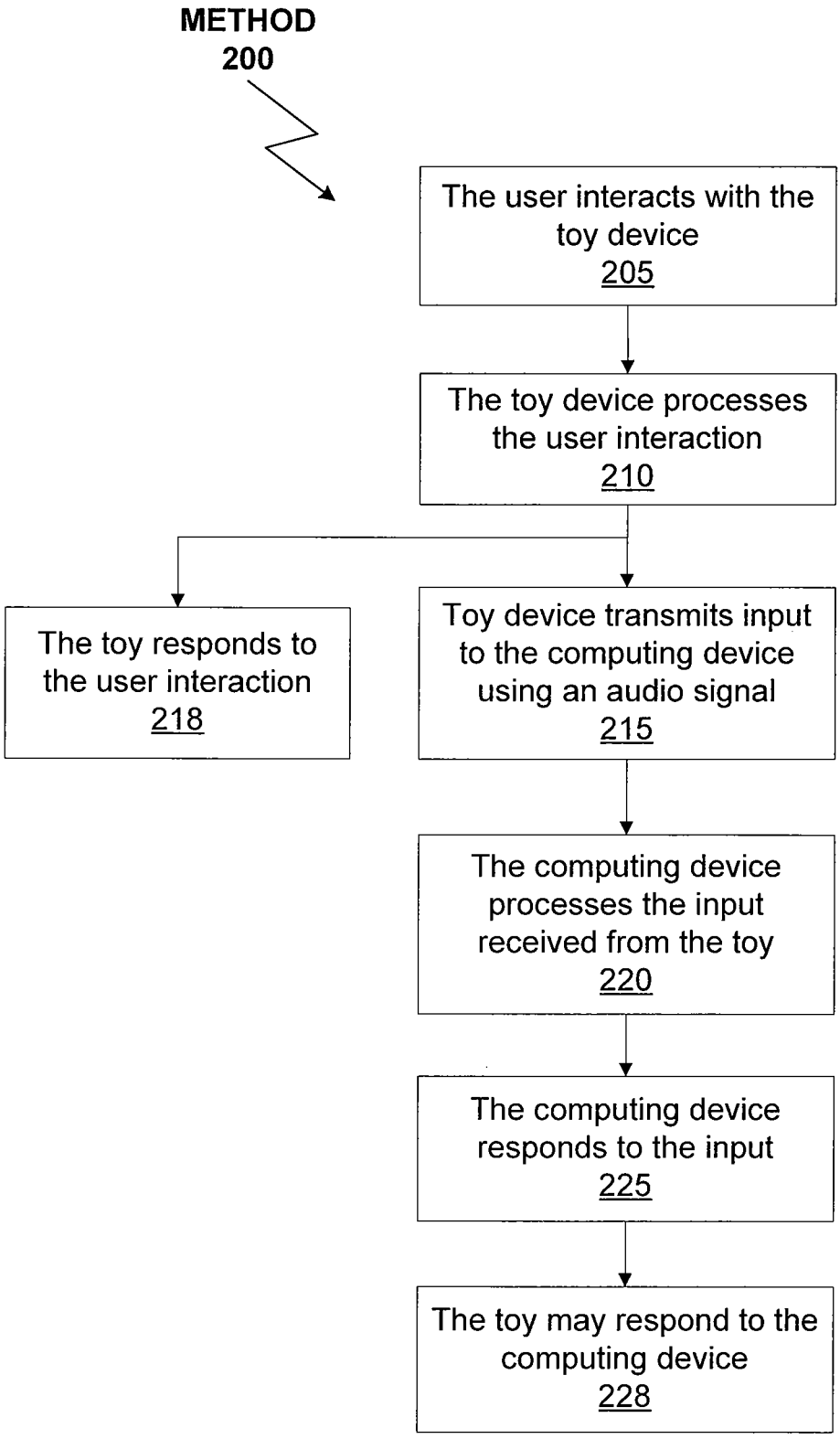
FIG. 2A is a flowchart of method steps describing wireless interactions between the toy device and a user and the toy device and a computing device, according to one embodiment of the invention.

FIG. 2A is a flowchart of method steps describing wireless interactions between the toy device 110 and the toy user 115 and the toy device 110 and a computing device, e.g., the computing device 130 and the mobile computing device 120, according to one embodiment of the invention. Persons skilled in the art would understand that, even though the method 200 is described in conjunction with the systems of FIGS. 1A, 1B, and 1C, any system configured to perform the method steps, in any order, is within the scope of embodiments of the invention. In one embodiment, the interaction application module 152 and/or the toy-related application module 132 may perform the method 200.

As shown, the method 200 begins at step 205, where the toy user 115 interacts with the toy device 110. The interaction may comprise speech and/or physical manipulation of the toy device 110. At step 210 the interaction application module 152 of the toy device 110 processes the user interaction. At step 215 the toy device 110 transmits an input to the computing device, where the input is encoded in an audio signal. The audio signal may be a nearly-inaudible frequency or an audible frequency. At step 218, in response to the user interaction, the toy device 110 may also generate an audio or visual response.

At step 220 the computing device receives the audio signal transmitted by the toy device 110 and processes the input. At step 225 the computing device responds to the input by generating and outputting a visual and/or auditory response. At step 228 the toy device 110 may receive the auditory response, i.e., audio signal, output by the computing device in step 225 and respond to the audio signal output by the computing device. The audio signal output by the computing device may by a nearly inaudible signal that encodes a command to be executed by the toy device 110 or the audio signal may be an audible sound that is recognized by the toy device 110. For example, the audio signal may be a laugh and the toy device 110 may laugh in response or the audio signal may be a spoken or encoded command to jump and the toy device 110 may jump in response.

Interactions that may be performed using the method 200 are that the toy user 115 interacts with the toy device 110 repositioning an arm of the toy device 110 to open a door. In turn, the computing device displays a sequence of images where an avatar corresponding to the toy device 110 opens a door in a virtual environment. The toy device 110 then outputs verbal commentary or hints intended to assist the toy user 115 in navigating through the virtual environment. In another example, the mobile device user 125 may read an electronic book displayed on the mobile computing device 120 or a physical book out loud and the toy device 110 may transmit a command to the mobile computing device 120 in response to the speech interaction generated by the mobile device user 125. The toy device 110 may also generate an audible sound and/or movement in response to the speech interaction.

Figure 2B:
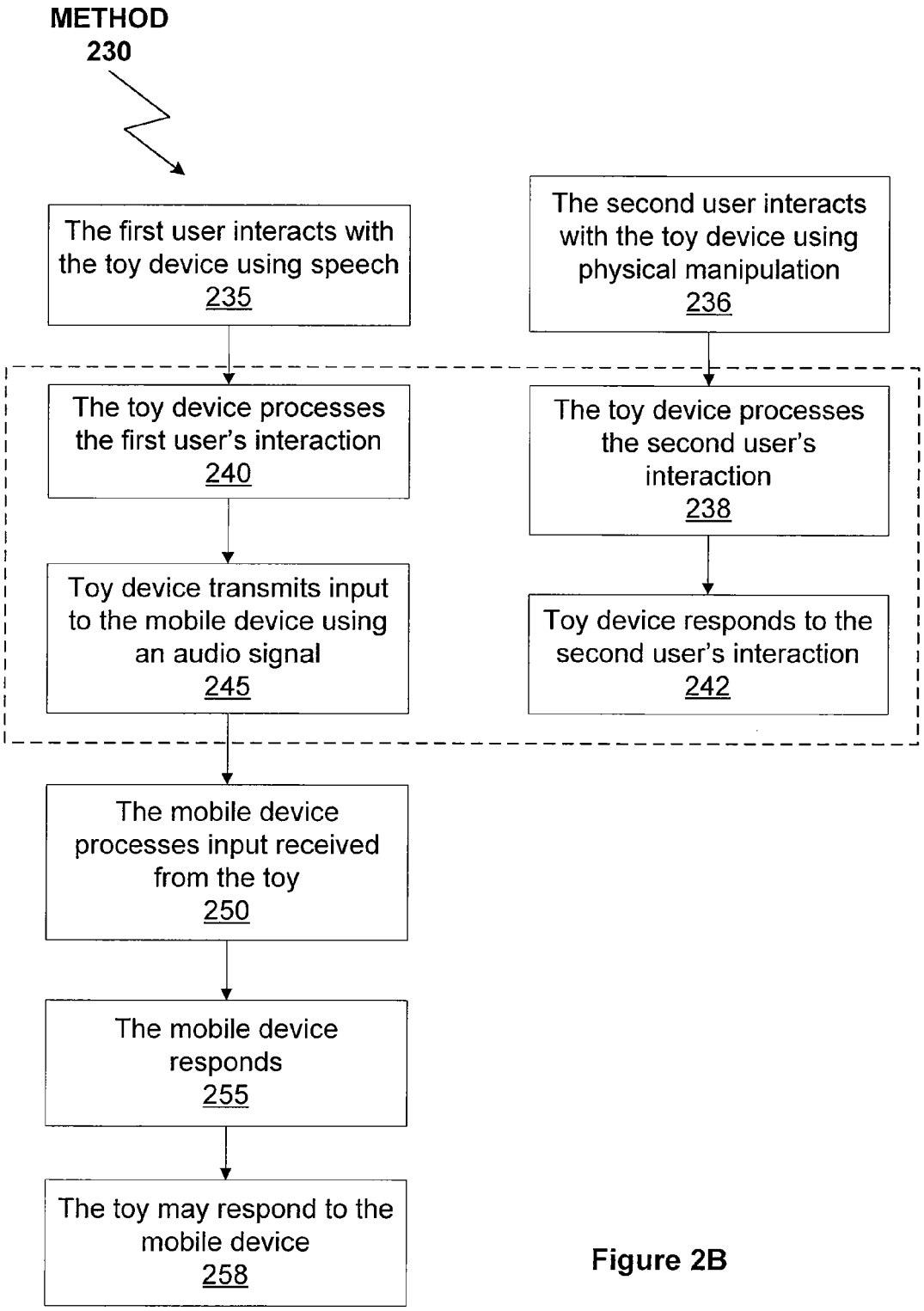
FIG. 2B is a flowchart of method steps describing simultaneous wireless interactions between the toy device and two users and the toy device and a mobile computing device, according to one embodiment of the invention.

FIG. 2B is a flowchart of method steps describing simultaneous wireless interactions between the toy device 110 and two users, the toy user 115 and the mobile device user 125, and the toy device 110 and the mobile computing device 120, according to one embodiment of the invention. Persons skilled in the art would understand that, even though the method 200 is described in conjunction with the systems of FIGS. 1A, 1B, and 1C, any system configured to perform the method steps, in any order, is within the scope of embodiments of the invention. In one embodiment, the interaction application module 152 and/or the toy-related application module 132 may perform the method 230.

As shown, the method 230 begins at steps 235 and 236. At step 235 a first user, e.g., the mobile device user 125 or a second toy user 115, interact with the toy device 110 using speech. In one embodiment, the first user may operate the mobile computing device 120 to generate the speech. At step 236, a second user, e.g., the toy user 115, interacts with the toy device 110 using physical manipulation. The toy device 110 may receive the interactions simultaneously, and at steps 238 and 240 the interaction application module 152 of the toy device 110 processes the first user's interaction and the second user's interaction. At step 242, in response to the second user's interaction, the toy device 110 generates an audio and/or visual response.

At step 245, the toy device 110 transmits an input to the mobile computing device 120, where the input is encoded in an audio signal. The audio signal may be a nearly-inaudible frequency or an audible frequency. At step 250, the mobile computing device 120 receives the audio signal transmitted by the toy device 110 and processes the input. At step 255 the mobile computing device 120 responds to the input by generating and outputting a visual and/or auditory response. At step 258 the toy device 110 may receive the auditory response, i.e., audio signal, output by the mobile computing device 120 in step 255 and respond to the audio signal. The audio signal output by the computing device may by a nearly inaudible signal that encodes a command to be executed by the toy device 110 or the audio signal may be an audible sound that is recognized by the toy device 110.

Interactions that may be performed using the method 230 are that the first user instructs the toy device 110 to "go to sleep" or physically manipulates the toy device into a horizontal position. The toy device 110 transmits a command to the mobile computing device 120 to play a lullaby. In response to hearing the lullaby, the toy device 110 may yawn. The second user may tickle the toy device 110 causing the toy device 110 to output a giggle sound or the second user may rub the back of the toy device 110 causing the toy device 110 to sigh. In another example, the first user may read an electronic book displayed on the mobile computing device 120 or a physical book out loud and the toy device 110 may transmit a command to the mobile computing device 120 in response to the speech interaction generated by the first user. The toy device 110 may simultaneously receive an interaction from the second user and generate an audible sound and/or movement in response to that interaction.

In yet another example, the first user may watch broadcast television or playback of a video content generated by the computing device 130 or the mobile computing device 120. The broadcast television signal or video content may include audible signals and nearly inaudible signals that encode information regarding a character that is an avatar for the toy device 110. The toy device 110 may transmit a command to the mobile computing device 120 in response to the interaction generated by the computing device 130 or the mobile computing device 120. The toy device 110 may simultaneously receive an interaction from the second user and generate an audible sound and/or movement in response to that interaction.

Advantageously, embodiments of the invention described above may be used to enable a toy device to interact with computing devices wirelessly, through audio signals. The ability to receive and transmit interactions and inputs wirelessly between the toy and computing devices allows for more and varied interactions between the toy device, computing devices, and human users.

Those skilled in the art will recognize that described systems, devices, components, methods, or algorithms may be implemented using a variety of configurations or steps. No single example described above constitutes a limiting configuration or number of steps. For example, configurations of the system 100 exist in which the described examples of components therein may be implemented as electronic hardware, computer software, or a combination of both. Illustrative examples have been described above in general terms of functionality. More or less components or steps may be implemented without deviating from the scope of this disclosure. Those skilled in the art will realize varying ways for implementing the described functionality, but such implementation should not be interpreted as a departure from the scope of this disclosure.

The invention has been described above with reference to specific embodiments and numerous specific details are set forth to provide a more thorough understanding of the invention. Persons skilled in the art, however, will understand that various modifications and changes may be made thereto without departing from the broader spirit and scope of the invention. The foregoing description and drawings are, accordingly, to be regarded in an illustrative rather than a restrictive sense.

What is claimed is:

1. A computer-implemented method for enabling interactions between a toy and a computing device, the method comprising:

receiving, by the toy device, a first interaction;

receiving, by the toy device and with the first interaction, a second interaction;

processing the first interaction to generate an input;

encoding the input into an audio signal;

wirelessly transmitting, at a nearly-inaudible frequency, the audio signal from the toy device to the computing device;

receiving, by the toy device, an auditory response generated by the computing device responsive to the computing device processing the audio signal;

processing, by the toy device, the auditory response to generate at least one of a first visual and second auditory response based on the auditory response output by the computing device; and processing the second interaction to generate at least one of a second visual and third auditory response.

2. The method of claim 1, wherein at least one of the first and second interactions is provided by one or more human users.

3. The method of claim 2, further comprising outputting a visual or auditory response in response to the input.

4. The method of claim 3, wherein at least one of the first and second interactions includes speaking to the toy device.

5. The method of claim 3, wherein at least one of the first and second interactions includes physically manipulating the toy device.

6. The method of claim 1, wherein the first interaction is provided by the computing device resulting from input received by the computing device from a human user.

7. The method of claim 1, wherein the computing device is further configured to output the second visual response based on the input.

8. The method of claim 1, wherein the audio signal encodes a command that the computing device is configured to execute.

9. The method of claim 1, wherein the nearly-inaudible frequency is selected from a frequency range between about 16 kilohertz (kHz) and about 20 kHz.

10. A non-transitory computer-readable storage medium storing instructions that, when executed by a processor, enable interactions between a toy and a computing device, by performing an operation comprising:

receiving, by the toy device, a first interaction;

receiving, by the toy device and with the first interaction, a second interaction;

processing the first interaction to generate an input;

encoding the input into an audio signal;

wirelessly transmitting, at a nearly-inaudible frequency, the audio signal from the toy device to the computing device;

receiving, by the toy device, an auditory response generated by the computing device responsive to the computing device processing the audio signal;

processing, by the toy device, the auditory response to generate at least one of a first visual and second auditory response based on the auditory response output by the computing device; and processing the second interaction to generate a second visual or third auditory response.

11. The non-transitory computer-readable storage medium of claim 10, wherein at least one of the first and second interactions is provided by one or more human users.

12. The non-transitory computer-readable storage medium of claim 11, further comprising outputting a third visual response by the computing device in response to the input.

13. The non-transitory computer-readable storage medium of claim 11, wherein at least one of the first and second interactions includes speaking to the toy device.

14. The non-transitory computer-readable storage medium of claim 11, wherein at least one of the first and second interactions includes physically manipulating the toy device.

15. The non-transitory computer-readable storage medium of claim 10, wherein the computing device is further configured to output the second visual response based on the input.

16. The non-transitory computer-readable storage medium of claim 11, wherein the audio signal encodes a command that the computing device is configured to execute.

17. The non-transitory computer-readable storage medium of claim 10, wherein the nearly-inaudible frequency is selected from a frequency range between about 16 kilohertz (kHz) and about 20 kHz.

18. A system comprising:

a toy device including a processor and a memory, wherein the memory includes an interaction application module configured to enable interactions between the toy device and a computing device by performing an operation, comprising:

receiving a first interaction, receiving a second interaction with the first interaction, processing the first interaction to generate an input, encoding the input into an audio signal, wirelessly transmitting, at a nearly-inaudible frequency, the audio signal to the computing device; and the computing device configured to process the audio signal and to output an auditory response based on the input, wherein the interaction application module is further configured to process the auditory response to generate at least one of a first visual and second auditory response based on the auditory response output by the computing device, and wherein the interaction application module is further configured to process the second interaction to generate at least one of a second visual and third auditory response.

19. The system of claim 18, wherein at least one of the first and second interactions includes at least one of speaking to the toy device and physically manipulating the toy device.

20. The system of claim 18, wherein the nearly inaudible frequency is selected from a frequency range between about 16 kilohertz (kHz) and about 20 kHz.

* * * * *

UNITED STATES PATENT AND TRADEMARK OFFICE

CERTIFICATE OF CORRECTION

PATENT NO. : 9,089,783 B2
APPLICATION NO. : 13/212653
DATED : July 28, 2015
INVENTOR(S) : Armen Mkrtchyan It is certified that error appears in the above-identified patent and that said Letters Patent is hereby corrected as shown below:

In the Claims:

Column 10, Claim 16, Line 47, please delete "11" and insert --10-- therefor.

Signed and Sealed this
Twelfth Day of January, 2016

Michelle K. Lee

Michelle K. Lee
*Director of the United States Patent and Trademark Office*